US009847162B2

(12) United States Patent
Nishiyama

(10) Patent No.: US 9,847,162 B2
(45) Date of Patent: Dec. 19, 2017

(54) ELECTRONIC COMPONENT

(71) Applicant: MURATA MANUFACTURING CO., LTD., Kyoto-fu (JP)

(72) Inventor: Kenji Nishiyama, Kyoto-fu (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 217 days.

(21) Appl. No.: 14/878,604

(22) Filed: Oct. 8, 2015

(65) Prior Publication Data

US 2016/0104565 A1 Apr. 14, 2016

(30) Foreign Application Priority Data

Oct. 14, 2014 (JP) ..... 2014-209594

(51) Int. Cl.
*H01F 5/00* (2006.01)
*H01F 27/28* (2006.01)
*H01F 17/00* (2006.01)

(52) U.S. Cl.
CPC ..... *H01F 17/0033* (2013.01); *H01F 17/0013* (2013.01); *H01F 2017/0066* (2013.01)

(58) Field of Classification Search
USPC ..... 336/200
See application file for complete search history.

(56) References Cited

U.S. PATENT DOCUMENTS 5,463,365 A * 10/1995 Iwatani ..... H01F 17/0013 336/192
7,843,701 B2 * 11/2010 Kudo ..... H01F 27/027 336/200

(Continued)

FOREIGN PATENT DOCUMENTS

CN 101763933 A 6/2010
CN 103578703 A 2/2014

(Continued)

OTHER PUBLICATIONS

An Office Action; "Notice of Reasons for Rejection," issued by the Japanese Patent Office dated Apr. 4, 2017, which corresponds to Japanese Patent Application No. 2014-209594 and is related to U.S. Appl. No. 14/878,604; with English language translation.

(Continued)

*Primary Examiner* — Elvin G Enad
*Assistant Examiner* — Ronald Hinson
(74) *Attorney, Agent, or Firm* — Studebaker & Brackett PC

(57) ABSTRACT

An electronic component includes a body formed of an insulator, a coil positioned in the body and including first and second coil conductors, an outer electrode including a first bottom-surface electrode and a first substantially columnar electrode (first electrode) and connected to the second conductor, and an outer electrode including a second bottom-surface electrode and a second substantially columnar electrode (second electrode) and connected to the first conductor. The second conductor is positioned between the first conductor and a bottom surface of the body. The second electrode is positioned to oppose the first electrode across the coil's central axis when viewed from the z-axis direction. An outermost peripheral portion of the first conductor is superposed with the first electrode when viewed from the z-axis direction. A smallest distance between the first conductor and a first side surface is smaller than that between the second conductor and a second side surface.

3 Claims, 8 Drawing Sheets

(56) References Cited

U.S. PATENT DOCUMENTS

| | | | | |
|---|---|---|---|---|
| 2006/0068602 | A1* | 3/2006 | Kamijima | H01F 17/0013 438/780 |
| 2007/0040163 | A1* | 2/2007 | Okuzawa | H01F 27/292 257/31 |
| 2010/0157565 | A1 | 6/2010 | Yoshida et al. | |
| 2011/0219790 | A1* | 9/2011 | Denton | F25B 45/00 62/77 |
| 2012/0133472 | A1* | 5/2012 | Nishikawa | H01F 17/04 336/200 |
| 2014/0022042 | A1 | 1/2014 | Park et al. | |
| 2014/0266547 | A1* | 9/2014 | Watanabe | H01F 17/0013 336/200 |
| 2015/0091685 | A1* | 4/2015 | Kitajima | H01F 17/0013 336/192 |

FOREIGN PATENT DOCUMENTS

| | | | |
|---|---|---|---|
| JP | 2007-067214 | A | 3/2007 |
| JP | 2013-098259 | A | 5/2013 |
| JP | 2014-022723 | A | 2/2014 |
| WO | 2012/077315 | A1 | 6/2012 |

OTHER PUBLICATIONS

The First Office Action issued by the State Intellectual Property Office of People's Republic of China dated Feb. 28, 2017, which corresponds to Chinese Patent Application No. 201510608942.2 and is related to U.S. Appl. No. 14/878,604; with English language translation.

* cited by examiner

ELECTRONIC COMPONENT

CROSS REFERENCE TO RELATED APPLICATIONS

This application claims benefit of priority to Japanese Patent Application No. 2014-209594 filed Oct. 14, 2014, the entire content of which is incorporated herein by reference.

TECHNICAL FIELD

The present disclosure relates to electronic components, and more particularly to an electronic component that is equipped with a coil.

BACKGROUND

An inductor described in Japanese Unexamined Patent Application Publication No. 2014-22723 is a known example of an electronic component that is equipped with a coil. As illustrated in FIG. 18, in an electronic component 500, which is an example of this type of electronic component, a substantially spiral coil conductor 510 whose shape is a combination of substantially semicircular arcs and substantially straight lines and a coil conductor 520 whose shape is the same as that of the coil conductor 510 are disposed within the electronic component 500 such that a central axis CL500 of the coil conductor 510 and another central axis CL500 of the coil conductor 520 substantially coincide with each other, and the coil conductor 510 and the coil conductor 520 are connected to each other so that a single coil 501 is formed. In order to be connected to an outer electrode, a connecting electrode 512, which is a first end portion of the coil conductor 510, has an area larger than that of each of other portions of the coil conductor 510, and a connecting electrode 522, which is a second end portion of the coil conductor 520, has an area larger than that of each of other portions of the coil conductor 520. In addition, when viewed from a central axial direction of the coil 501, the two coil conductors 510 and 520 are each disposed so as to have a line-symmetrical configuration with respect to a straight line HL500 (see FIG. 19) that crosses the central axes CL500 and that is perpendicular to substantially linear portions of the coil conductors 510 and 520. Furthermore, when viewed from the central axial direction of the coil 501, the coil conductor 510 is disposed so as not to be superposed with the connecting electrode 522 of the coil conductor 520. Note that, in FIG. 19, the connecting electrode 522 of the coil conductor 520 is indicated by a dashed line.

Such electronic components, each of which is equipped with a coil, have been mounted in mobile devices including smartphones and have been further reduced in size along with an improvement in integration of such mobile devices. However, although such electronic components, each of which is equipped with a coil, have been reduced in size, there has been a growing demand for higher performance, such as inductance, of the electronic components. Therefore, in this type of electronic component, there is a need to increase the inductance as much as possible in a limited space in which a coil is to be embedded.

SUMMARY

Accordingly, it is an object of the present disclosure to provide an electronic component that is equipped with a coil and whose inductance can be increased.

According to a preferred embodiment of the present disclosure, there is provided an electronic component including a main body that is formed of an insulator, a coil that includes a first coil conductor that is disposed on a first plane, which is positioned within the main body, and a second coil conductor that is disposed on a second plane, which is parallel to the first plane within the main body, so as to be superposed with the first coil conductor when viewed from a perpendicular direction, which is perpendicular to the first plane, a first outer electrode that includes a first bottom-surface electrode located on a bottom surface of the main body, which is parallel to the first plane, and a first substantially columnar electrode extending from the first bottom-surface electrode toward a first end portion of the first coil conductor and that is electrically connected to the first coil conductor, and a second outer electrode that includes a second bottom-surface electrode located on the bottom surface and a second substantially columnar electrode extending from the second bottom-surface electrode toward a second end portion of the second coil conductor and that is electrically connected to the second coil conductor. The second coil conductor is positioned between the first coil conductor and the bottom surface. The first substantially columnar electrode is positioned so as to oppose the second substantially columnar electrode across a central axis of the coil when viewed from the perpendicular direction. A portion of an outermost periphery of the first coil conductor is superposed with the second substantially columnar electrode when viewed from the perpendicular direction. A smallest distance between the first coil conductor and a first side surface of the main body is smaller than a smallest distance between the second coil conductor and a second side surface of the main body.

In the electronic component according to the preferred embodiment of the present disclosure, the portion of the outermost periphery of the first coil conductor is superposed with the second substantially columnar electrode when viewed from the direction perpendicular to the first plane, and the smallest distance between the first coil conductor and the first side surface of the main body is smaller than the smallest distance between the second coil conductor and the second side surface of the main body. That is to say, in the electronic component according to the preferred embodiment of the present disclosure, a space within the main body, which corresponds to a space within a main body of an electronic component of the related art that has not been used, is used as a space in which the first coil conductor is disposed. Therefore, the external size of the first coil conductor can be further increased, and as a result, an improvement of the inductance of the electronic component can be achieved.

According to the preferred embodiments of the present disclosure, the inductance of an electronic component that is equipped with a coil can be increased.

Other features, elements, characteristics and advantages of the present disclosure will become more apparent from the following detailed description of preferred embodiments of the present disclosure with reference to the attached drawings.

DETAILED DESCRIPTION

Configuration of Electronic Component (see FIG. 1 to FIG. 5)

An electronic component 1, which is an embodiment of the present disclosure, will be described with reference to the drawings. In the following description, a direction perpendicular to a bottom surface of the electronic component 1 is defined as the z-axis direction. When viewed in plan in the z-axis direction, a direction parallel to a long side of the electronic component 1 is defined as the x-axis direction, and a direction parallel to a short side of the electronic component 1 is defined as the y-axis direction. Note that the x axis, the y axis, and the z axis are perpendicular to one another.

Figure 1:
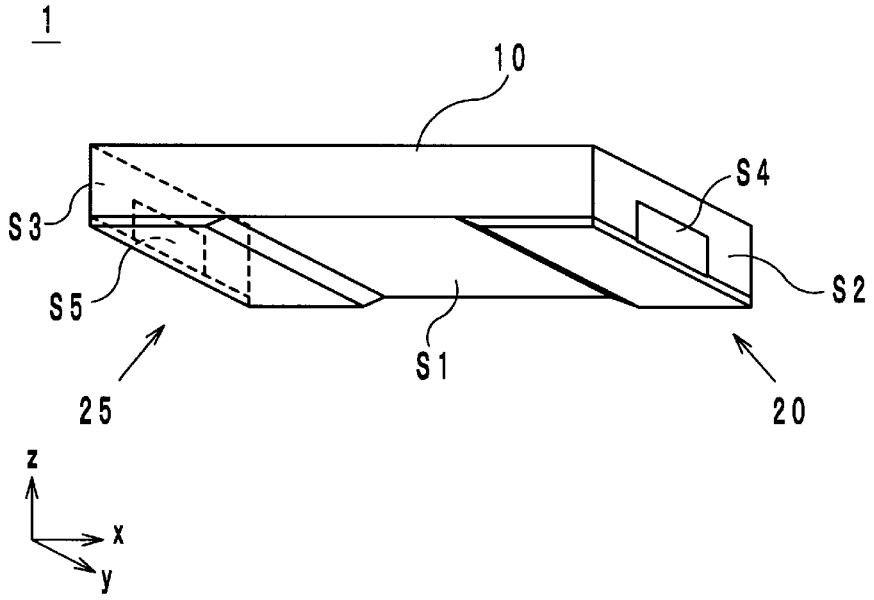
FIG. 1 is a diagram illustrating the appearance of an electronic component, which is an embodiment of the present disclosure.

The electronic component 1 includes a main body 10, outer electrodes 20 and 25, and a coil 30. As illustrated in FIG. 1, the electronic component 1 has a substantially rectangular parallelepiped shape.

Figure 2:
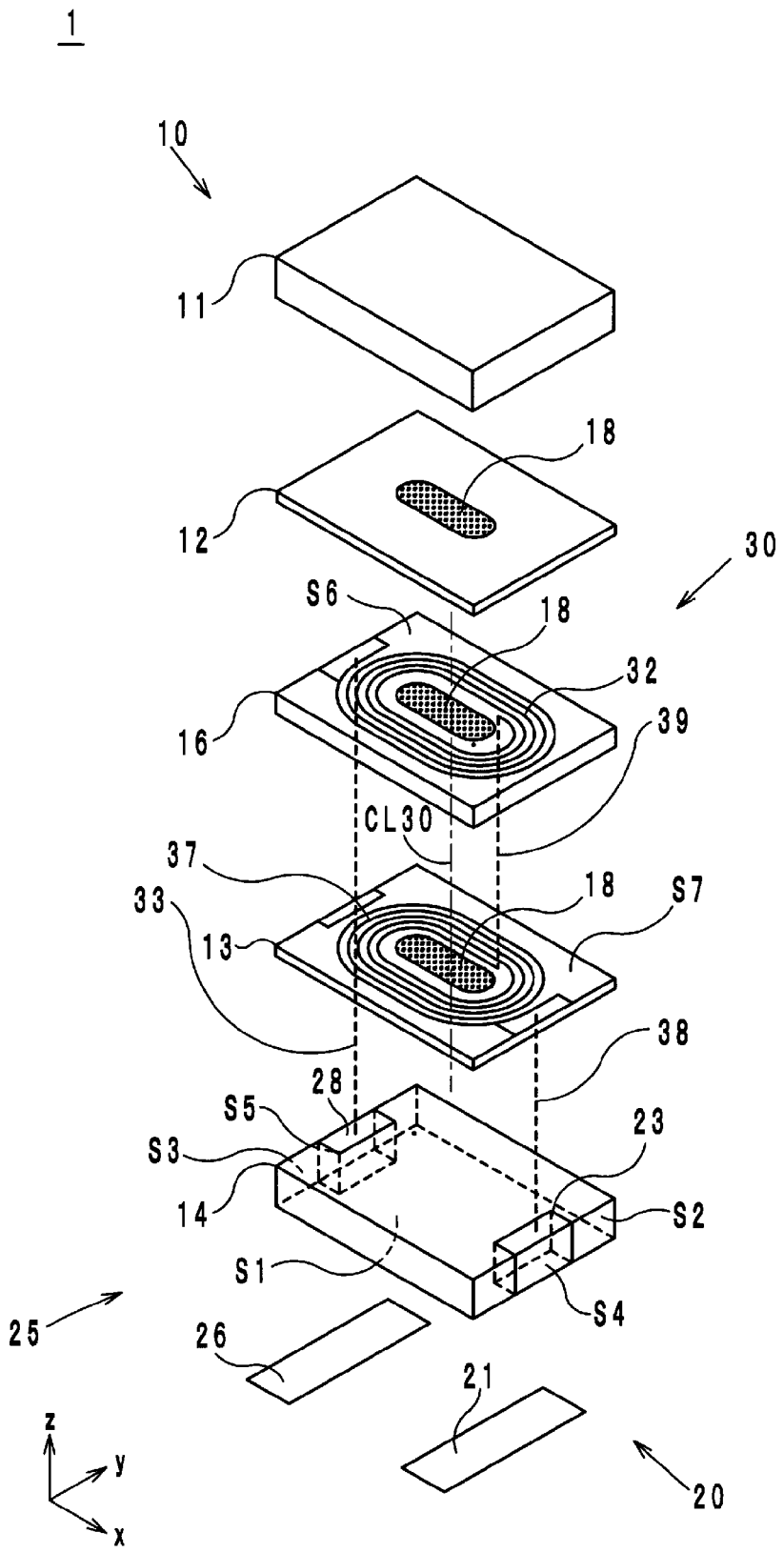
FIG. 2 is an exploded perspective view of the electronic component, which is the embodiment.

As illustrated in FIG. 2, the main body 10 includes insulator layers 11 to 14, an insulator substrate 16, and a magnetic path 18. In the main body 10, the insulator layers 11 and 12, the insulator substrate 16, and the insulator layers 13 and 14 are stacked one on top of the other in this order from the positive z-axis direction to the negative z-axis direction.

The insulator layers 11 and 14 are each made of a resin, which contains a magnetic powder, or the like. Note that examples of the magnetic powder include ferrite and a metal magnetic material (FeSiCr or the like), and examples of the resin include a polyimide resin and an epoxy resin. In the present embodiment, the resin contains about 90 wt % or higher of the magnetic powder by taking the L value and the direct current superposition characteristics of the electronic component 1 into consideration. The insulator layer 11 is positioned so as to serve as an end portion of the main body 10 on the positive-z-axis-direction side. The insulator layer 14 is positioned so as to serve as an end portion of the electronic component 1 on the negative-z-axis-direction side, and a bottom surface S1 of the insulator layer 14, which is a surface on the negative-z-axis-direction side, is a mounting surface that is used when the electronic component 1 is mounted on a circuit board.

The insulator layers 12 and 13 are each made of an epoxy resin or the like. The insulator layer 12 is positioned adjacent to the insulator layer 11 on the negative-z-axis-direction side, and the insulator layer 13 is positioned adjacent to the insulator layer 14 on the positive-z-axis-direction side. Note that the material of the insulator layers 12 and 13 may be an insulating resin, such as benzocyclobutene, or an insulating inorganic material, such as a glass ceramic.

The insulator substrate 16 is a printed circuit board that is formed of glass cloth impregnated with an epoxy resin and is sandwiched between the insulator layer 12 and the insulator layer in the z-axis direction. Note that the material of the insulator substrate 16 may be an insulating resin, such as benzocyclobutene, or an insulating inorganic material, such as a glass ceramic.

The magnetic path 18 is made of a resin containing a magnetic powder and is positioned substantially at the center within the main body 10. Note that examples of the magnetic powder include ferrite and a metal magnetic material (FeSiCr or the like), and examples of the resin include a polyimide resin and an epoxy resin. In the present embodiment, the resin contains about 90 wt % or higher of the magnetic powder by taking the L value and the direct current superposition characteristics of the electronic component 1 into consideration. In addition, in order to improve a filling property of the resin with respect to the magnetic path 18, two types of powders having different grain sizes are present in the resin. The magnetic path 18 extends the insulator layers 12 and 13 and the insulator substrate 16 in the z-axis direction, and the cross section of the magnetic path 18 has a substantially oval columnar shape. In addition, the magnetic path 18 is arranged so as to be located on the inner periphery side of coil conductors 32 and 37, each of which will be described later.

The outer electrode 20 is disposed on the bottom surface S1 and a side surface S2 of the main body 10 the positive-x-axis-direction side when viewed from outside the main body 10. The outer electrode 20 includes a bottom-surface electrode 21 that is made of a composite material containing a metal and a resin, and a substantially columnar electrode 23 that is made of Cu. Note that examples of other materials that can be used as the material of the substantially columnar electrode 23 include Au, Ag, Pd, and Ni.

The bottom-surface electrode 21 is a so-called resin electrode that is made of a phenolic resin in which a low-resistance metal powder, which is a Ag-coated Cu powder having an average particle diameter of about 100 nm in the present embodiment, is dispersed. The bottom-surface electrode 21 is an electrode that has a substantially flat plate-like shape and that is disposed in a region of the bottom surface S1 of the insulator layer 14 on the positive-x-axis-direction side. The bottom-surface electrode 21 has a substantially rectangular shape when seen in plan view from the negative z-axis-direction.

The substantially columnar electrode 23 is an electrode that is disposed in a region inside the main body 10 on the positive-x-axis-direction side and that extends through the insulator layer 14 in the z-axis direction. However, a side surface S4 of the substantially columnar electrode 23 on the positive-x-axis-direction side is exposed at the side surface S2 of the main body 10. The substantially columnar electrode 23 has a substantially rectangular parallelepiped shape. In addition, when the substantially columnar electrode 23 is seen in plan view from the z-axis direction, the substantially columnar electrode is positioned within the bottom-surface electrode 21. The area of the side surface S4 of the substantially columnar electrode 23 is smaller than the area of the bottom-surface electrode 21. A surface of the substantially columnar electrode on the negative-z-axis-direction side ("surface on the negative-z-axis-direction side" will hereinafter be referred to as a bottom surface) is in contact with a surface of the bottom-surface electrode 21 on the positive-z-axis-direction side ("surface on the positive-z-axis-direction side" will hereinafter be referred to as a top surface).

The outer electrode 25 is disposed on the bottom surface S1 and a side surface S3 of the main body 10 on the negative-x-axis-direction side when viewed from outside the main body 10. The outer electrode 25 includes a bottom-surface electrode 26 that is made of a composite material containing a metal and a resin, and a substantially columnar electrode 28 that is made of Cu or the like. Note that examples of other materials that can be used as the material of the substantially columnar electrode 28 include Au, Ag, Pd, and Ni.

The bottom-surface electrode 26 is a so-called resin electrode that is made of a phenolic resin in which a low-resistance metal powder, which is a Ag-coated Cu powder having an average particle diameter of about 100 nm in the present embodiment, is dispersed. The bottom-surface electrode 26 is an electrode that has a substantially flat plate-like shape and that is disposed in a region of the bottom surface S1 of the insulator layer 14 on the negative-x-axis-direction side. The bottom-surface electrode 26 has a substantially rectangular shape when seen in plan view from the negative z-axis-direction.

Figure 3:
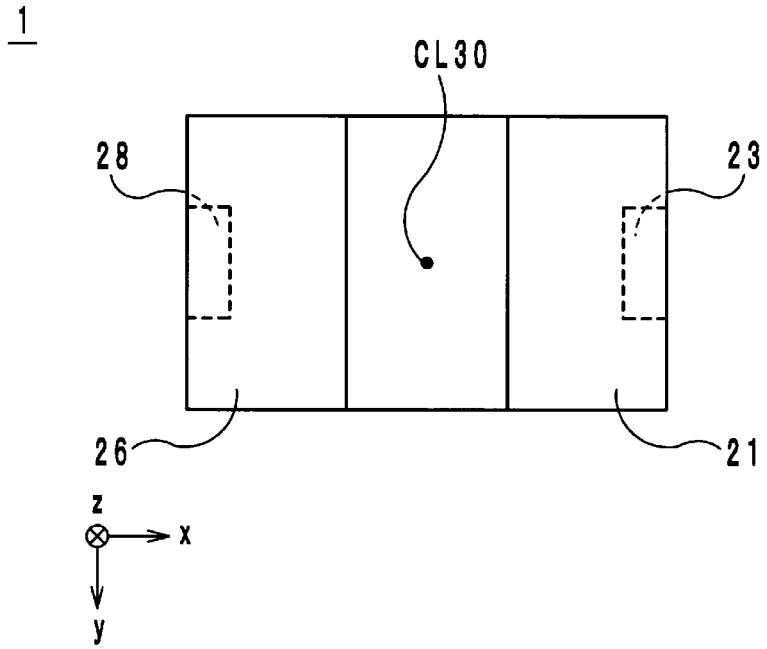
FIG. 3 is a diagram illustrating a bottom surface of the electronic component, which is the embodiment, when seen in plan view.

The substantially columnar electrode 28 is an electrode that is disposed in a region inside the main body 10 on the negative-x-axis-direction side and that extends through the insulator layer 14 in the z-axis direction. However, a side surface S5 of the substantially columnar electrode 28 on the negative-x-axis-direction side is exposed at the side surface S3 of the main body 10. The substantially columnar electrode 28 has a substantially rectangular parallelepiped shape. In addition, when the substantially columnar electrode 28 is seen in plan view from the z-axis direction, the substantially columnar electrode is positioned within the bottom-surface electrode 26. The area of the side surface S5 of the substantially columnar electrode 28 is smaller than the area of the bottom-surface electrode 26. A bottom surface of the substantially columnar electrode 28 is in contact with a top surface of the bottom-surface electrode 26. In addition, as illustrated in FIG. 3, the substantially columnar electrode 28 is positioned so as to oppose the substantially columnar electrode 23 across a central axis CL30 of the coil 30.

As illustrated in FIG. 2, the coil 30 is positioned in the main body 10 and formed of a conductive material, such as Au, Ag, Cu, Pd, or Ni. In addition, the coil 30 includes a coil conductor 32, a via conductor 33, the coil conductor 37, and via conductors 38 and 39.

Figure 4:
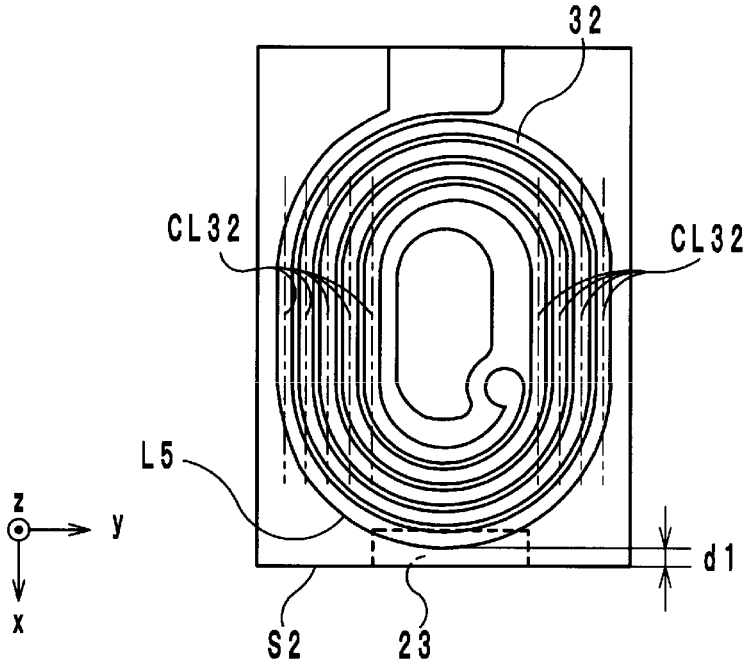
FIG. 4 is a plan view illustrating a coil conductor, an insulator layer, and a substantially columnar electrode of the electronic component, which is the embodiment, as seen from a direction perpendicular to the bottom surface.
Figure 5:
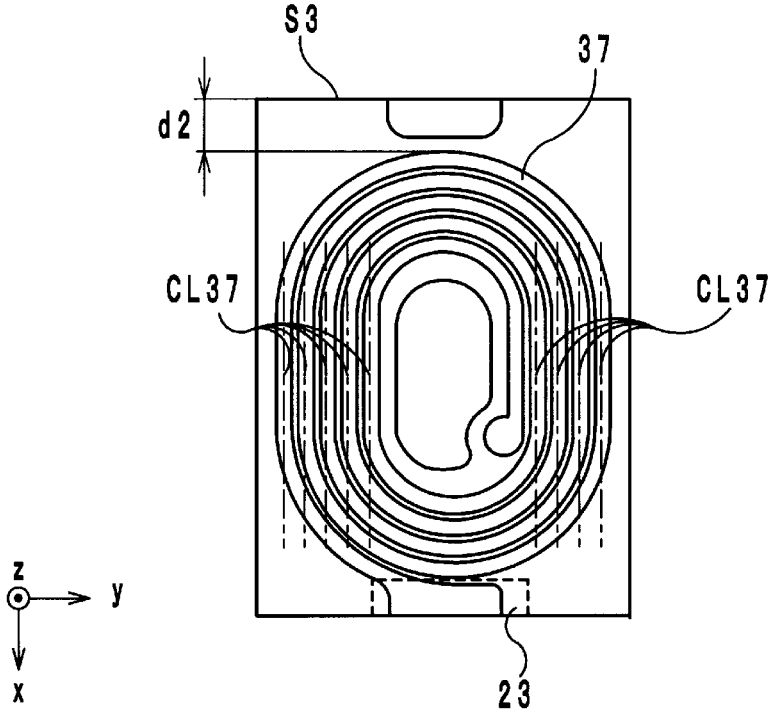
FIG. 5 is a plan view illustrating a coil conductor, the insulator layer, and the substantially columnar electrode of the electronic component, which is the embodiment, as seen from a direction perpendicular to the bottom surface.

The coil conductor 32 is disposed on a top surface S6 of the insulator substrate 16. The coil conductor 32 includes a plurality of substantially linear portions and a plurality of substantially arc portions and is a substantially spiral linear conductor that spirals in a clockwise direction with increasing distance from its center when viewed in plan from the positive z-axis direction. A first end portion of the coil conductor 32 on the outer periphery side of the coil conductor 32 extends toward the side surface S3 of the main body 10. When the coil conductor 32 is viewed from the z-axis direction, as illustrated in FIG. 4, an outermost peripheral portion L5 of the coil conductor 32 on the positive-x-axis-direction side is superposed with the substantially columnar electrode 23. A smallest distance d1 between the coil conductor 32 and the side surface S2 is half or less of a smallest distance d2 between the coil conductor 37, which will be described later, and the side surface S3.

As illustrated in FIG. 2, the via conductor 33 connects the first end portion of the coil conductor 32 on the outer periphery side and the substantially columnar electrode 28. Thus, the via conductor 33 extends through the insulator substrate 16 and the insulator layer 13 in the z-axis direction.

The coil conductor 37 is disposed on a bottom surface of the insulator substrate 16, that is, on a top surface S7 of the insulator layer 13. The coil conductor 37 includes a plurality of substantially linear portions and a plurality of substantially arc portions and is a substantially spiral linear conductor that spirals in the clockwise direction with decreasing distance from its center when viewed in plan from the positive z-axis direction. A first end portion of the coil conductor 37 on the outer periphery side of the coil conductor 37 extends toward the side surface S2 of the main body 10. A second end portion of the coil conductor 37 on the inner periphery side of the coil conductor 37 is arranged so as to be superposed with a second end portion of the coil conductor 32 on the inner periphery side of the coil conductor 32 when viewed from the z-axis direction. Regarding first portions that are parts of the substantially linear portions of the coil conductor 32 and second portions that are parts of the substantially linear portions of the coil conductor 37, each of the first portions being superposed with a corresponding one of the second portions when viewed from the z-axis direction, each of central axes CL32 of the coil conductor 32 illustrated in FIG. 4, which are the central axes of the first portions in their width direction, substantially coincide with a corresponding one of central axes CL37 of the coil conductor 37 illustrated in FIG. 5, which are the central axes of the second portions in their width direction, when viewed from the z-axis direction.

As illustrated in FIG. 2, the via conductor 38 connects the first end portion of the coil conductor 37 on the outer periphery side and the substantially columnar electrode 23. Thus, the via conductor 38 extends the insulator layer 13 in the z-axis direction.

The via conductor 39 extends through the insulator substrate 16 in the z-axis direction and connects the second end portion of the coil conductor 32 on the inner periphery side and the second end portion of the coil conductor 37 on the inner periphery side.

The electronic component 1, which has the above-described configuration, functions as an inductor as a result of a signal, which is input from the outer electrode 20 or the outer electrode 25, being output from the outer electrode 25 or the outer electrode 20 through the coil 30.

Manufacturing Method (see FIG. 6 to FIG. 17)

A method of manufacturing the electronic component 1, which is an embodiment of the present disclosure, will be described below. The z-axis direction used in the following description of the manufacturing method is a direction perpendicular to bottom surfaces of electronic components 1, which are to be manufactured by the manufacturing method.

Figure 6:
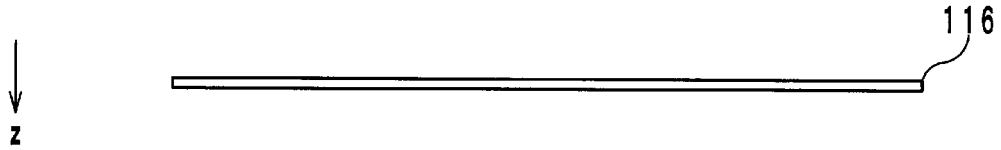
FIG. 6 is a diagram illustrating a process of manufacturing the electronic component of the embodiment.
Figure 7:
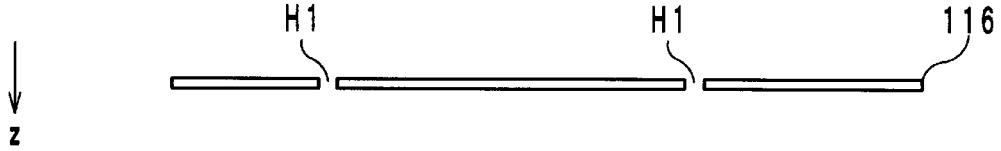
FIG. 7 is a diagram illustrating a process of manufacturing the electronic component of the embodiment.

First, as illustrated in FIG. 6, a mother insulator substrate 116 that is to be a plurality of insulator substrates 16 is prepared. Then, as illustrated in FIG. 7, a plurality of through holes H1 are formed in the mother insulator substrate 116 by laser processing or the like in order to form a plurality of via conductors 39.

Figure 8:
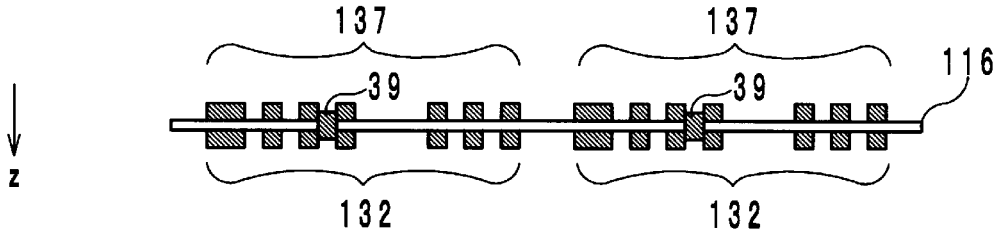
FIG. 8 is a diagram illustrating a process of manufacturing the electronic component of the embodiment.

Next, a top surface and a bottom surface of the mother insulator substrate 116, in which the plurality of through holes H1 have been formed, are plated with Cu. In this case, the inner surface of each of the through holes H1 is also plated, and as a result, the plurality of via conductors 39 are formed. After that, a plurality of conductive patterns 132 and 137, which are illustrated in FIG. 8 and correspond to coil conductors 32 and 37, are formed on the top surface and the bottom surface of the mother insulator substrate 116 by photolithography.

Figure 9:
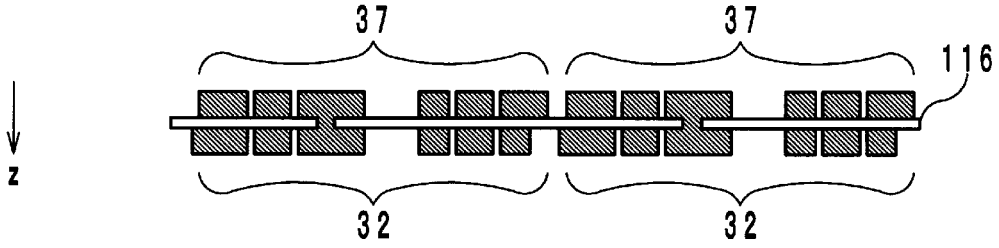
FIG. 9 is a diagram illustrating a process of manufacturing the electronic component of the embodiment.

After the plurality of conductive pattern 132 and 137 have been formed, the top surface and the bottom surface of the mother insulator substrate 116 are further plated with Cu, and the plurality of coil conductors 32 and 37 illustrated in FIG. 9, each of which has a sufficient thickness, are obtained.

Figure 10:
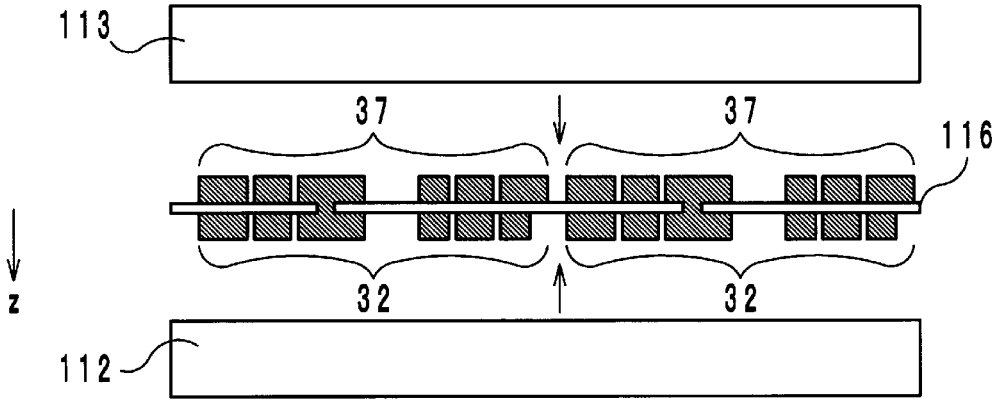
FIG. 10 is a diagram illustrating a process of manufacturing the electronic component of the embodiment.

Then, as illustrated in FIG. 10, the mother insulator substrate 116, on which the plurality of coil conductors 32 and 37 have been formed, is sandwiched by insulator sheets 112 and 113, which are to be a plurality of insulator layers 12 and 13, in the z-axis direction.

Figure 11:
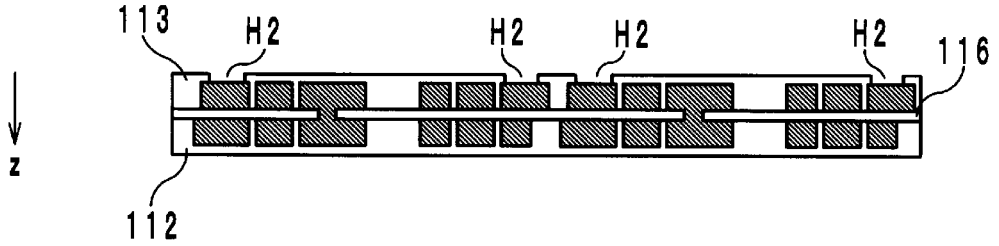
FIG. 11 is a diagram illustrating a process of manufacturing the electronic component of the embodiment.

Next, as illustrated in FIG. 11, a plurality of through holes H2 are formed in the insulator sheets 112 and 113 by laser processing or the like in order to form a plurality of via conductors 33 and 38. In addition, a de-smearing treatment is performed in order to remove smear generated as a result of the formation of the through holes H2.

After the de-smearing treatment has been performed, the insulator sheet 113 is plated with electroless copper first. This electroless plating is performed in order to form a seed layer used for a Cu electrolytic plating that is to be subsequently performed. After the seed layer has been formed, the Cu electrolytic plating is performed on the insulator sheet 113. As a result, a surface of the insulator sheet 113 and the inner surface of each of the through holes H2 are plated, and the plurality of via conductors 33 and 38 are formed.

Figure 12:
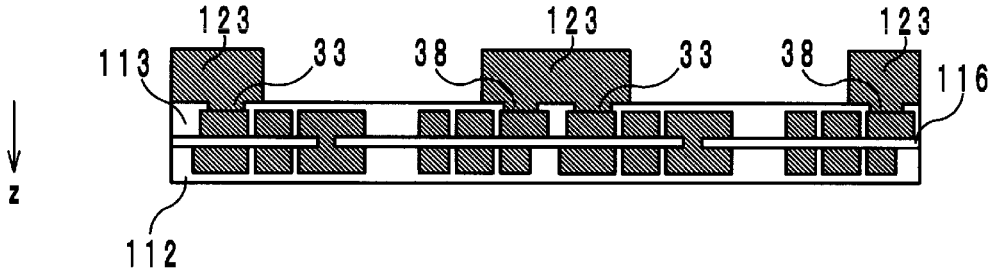
FIG. 12 is a diagram illustrating a process of manufacturing the electronic component of the embodiment.

After that, as illustrated in FIG. 12, a plurality of conductive patterns 123, which correspond to substantially columnar electrodes 23 and 28 and each of which has a sufficient thickness, are formed on the insulator sheet 113 by photolithography and Cu plating.

Figure 13:
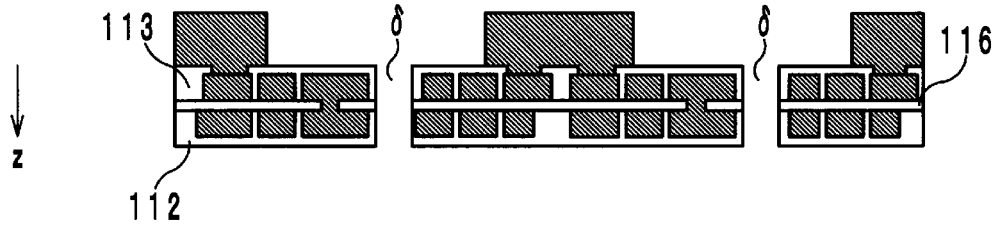
FIG. 13 is a diagram illustrating a process of manufacturing the electronic component of the embodiment.

Next, as illustrated in FIG. 13, a plurality of through holes δ that extend through the mother insulator substrate 116 and the insulator sheets 112 and 113 in the z-axis direction are formed by laser processing or the like in order to form magnetic paths 18. In an xy plane, the through holes δ are to be formed at positions on the inner periphery side of the plurality of coil conductors 32 and 37, which have been formed on the mother insulator substrate 116. Note that the through holes δ may be formed by using a mask having cavities that correspond to the through holes δ and performing sandblasting through the cavities.

Figure 14:
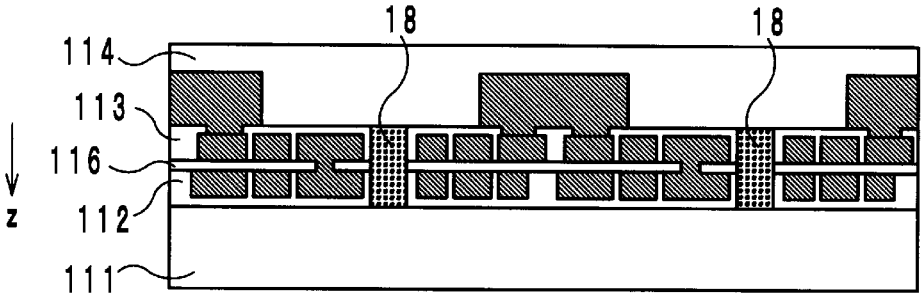
FIG. 14 is a diagram illustrating a process of manufacturing the electronic component of the embodiment.

Then, as illustrated in FIG. 14, a multilayer body that includes the insulator sheet 112, the mother insulator substrate 116, and the insulator sheet 113, which are stacked one on top of the other in this order, is sandwiched by resin sheets 111 and 114 containing a metal magnetic powder and corresponding to insulator layers 11 and 14 in the z-axis direction and is subjected to pressure bonding. In this case, the resin sheet 111 containing a metal magnetic powder is subjected to the pressure bonding from the side on which the insulator sheet 112 is disposed, and the resin sheet 114 containing a metal magnetic powder is subjected to the pressure bonding from the side on which the insulator sheet 113 is disposed. The resin sheets 111 and 114 each containing a metal magnetic powder enter the plurality of through holes δ by the pressure bonding, and as a result, the plurality of magnetic paths 18 are formed. After that, a heat treatment is performed by using a constant-temperature chamber, such as an oven so that the resin sheets 111 and 114 are cured.

Figure 15:
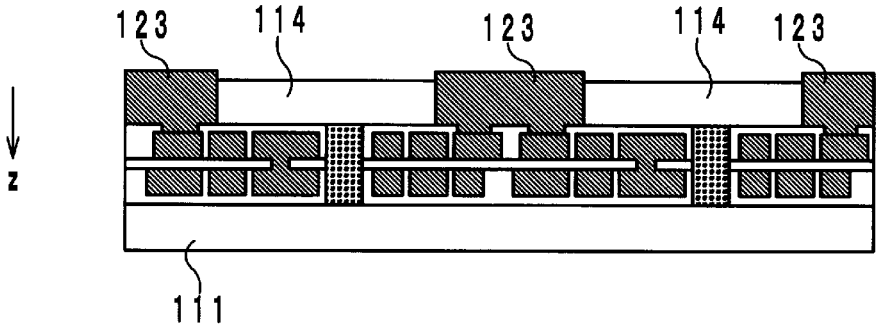
FIG. 15 is a diagram illustrating a process of manufacturing the electronic component of the embodiment.

Next, a surface of the resin sheet 114 is ground by buffing, lapping, grinder working, or the like. As a result, as illustrated in FIG. 15, the conductive patterns 123 are exposed at the surface of the resin sheet 114. Note that, when the grinding is performed on the resin sheet 114, a surface of the resin sheet 111 may be ground in order to adjust the thickness of each of the electronic components 1.

Figure 16:
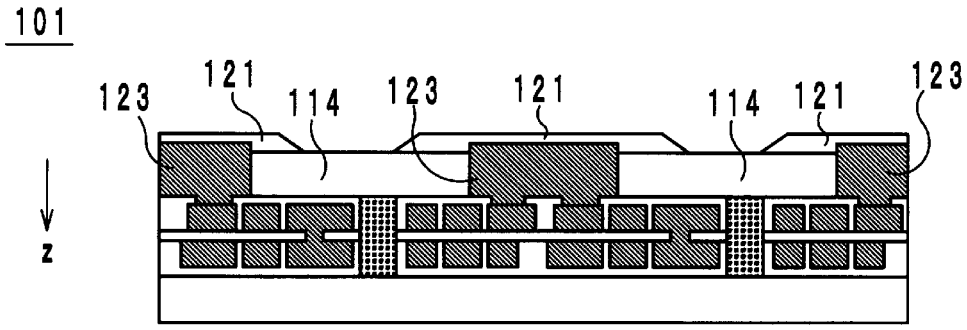
FIG. 16 is a diagram illustrating a process of manufacturing the electronic component of the embodiment.

A phenolic resin in which a Ag-coated Cu powder having an average particle diameter of about 100 nm is dispersed is applied to the conductive patterns 123, which have been exposed at the surface of the resin sheet 114, by screen printing, and the phenolic resin is dried, so that a plurality of resin electrode patterns 121 illustrated in FIG. 16 that correspond to bottom-surface electrodes 21 and 26 are formed on the surface of the resin sheet 114. As a result, a mother substrate 101, which is an aggregate of the plurality of electronic components 1, is completed.

Figure 17:
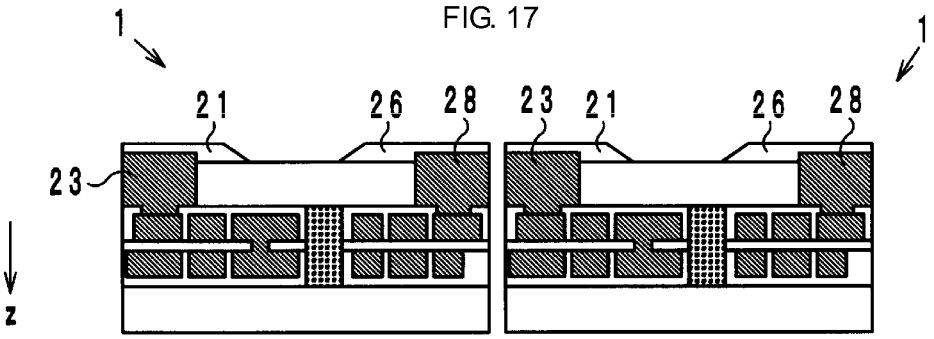
FIG. 17 is a diagram illustrating a process of manufacturing the electronic component of the embodiment.
Figure 18:
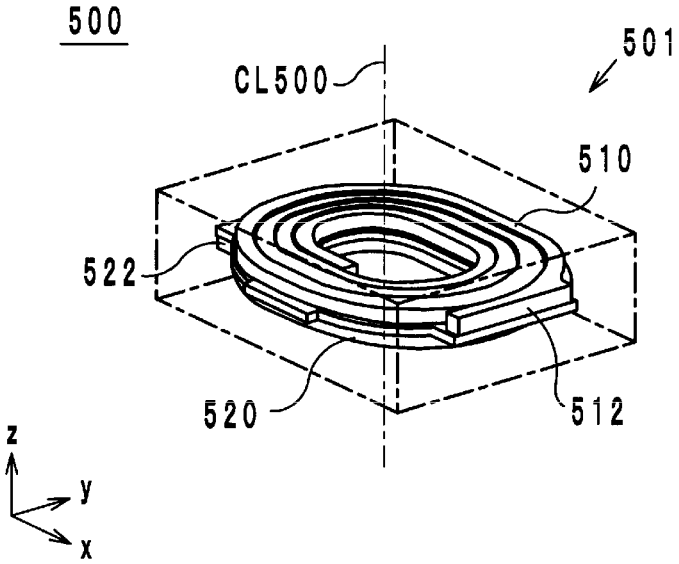
FIG. 18 PRIOR ART
FIG. 18 is a perspective view illustrating an internal structure of an electronic component, which is the same type as the inductor described in Japanese Unexamined Patent Application No. 2014-22723.
Figure 19:
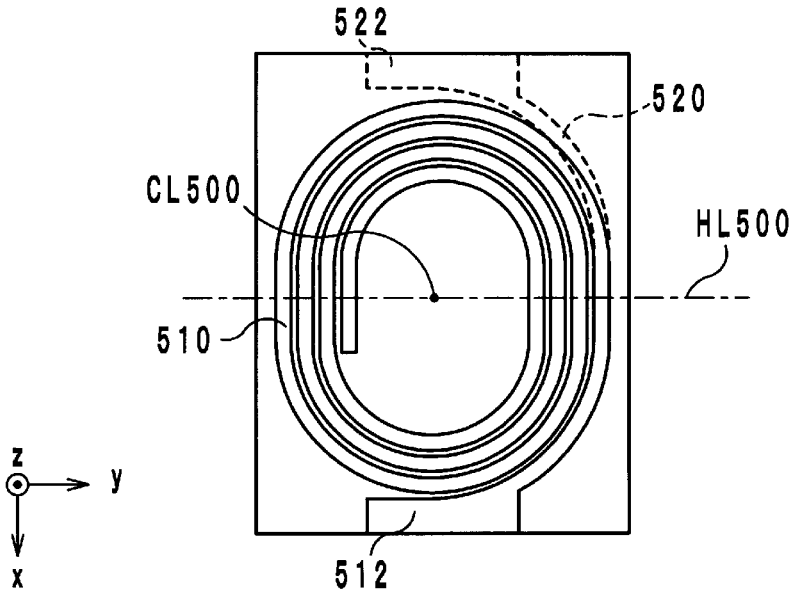
FIG. 19 PRIOR ART
FIG. 19 is a plan view illustrating a coil conductor and a connecting electrode of the electronic component, which is the same type as the inductor described in Japanese Unexamined Patent Application No. 2014-22723, as seen from a direction perpendicular to a bottom surface.

Finally, the mother substrate 101 is divided into the plurality of electronic components 1. More specifically, the mother substrate 101 is cut by using a dicer or the like, and as illustrated in FIG. 17, the mother substrate 101 is divided into the plurality of electronic components 1. In this case, each of the conductive patterns 123 is divided into two portions, and the two portions serve as the columnar electrodes 23 and 28. In addition, each of the resin electrode patterns 121 is also divided into two portions, and the two portions serve as the bottom-surface electrodes 21 and 26. Note that, after the mother substrate 101 has been divided into the plurality of electronic components 1, nickel plating and tin plating may be performed on surfaces of the outer electrodes 20 and 25 in order to improve the wettability of each of the outer electrodes 20 and 25.

Advantageous Effects

The inductance of the electronic component 1, which is an embodiment of the present disclosure, can be improved more than that of the electronic component 500. More specifically, in the electronic component 500 of the related art, the coil conductor 510, which corresponds to the coil conductor 32 of the electronic component 1, is arranged so as not to be superposed with the connecting electrode 522 of the coil conductor 520 when viewed from the central axial direction of the coil 501. Thus, in the electronic component 500, an area on the inner periphery side of the coil conductor 510 becomes small by an amount equal to the area occupied by the connecting electrode 522. On the other hand, in the electronic component 1, as illustrated in FIG. 4, the outermost peripheral portion L5 of the coil conductor 32, which corresponds to the coil conductor 510 of the electronic component 500, is superposed with the substantially columnar electrode 23, which corresponds to the connecting electrode 522 of the electronic component 500, when viewed from the z-axis direction. In addition, the smallest distance d1 between the coil conductor 32 and the side surface S2 of the main body 10 is smaller than the smallest distance d2 between the coil conductor 37 and the side surface S3 of the main body 10. That is to say, in the electronic component 1, a space within the electronic component 1, which corresponds to a space within the electronic component 500 of the related art that has not been used, is used as a space in which the coil conductor 32 is disposed. Consequently, an area on the inner periphery side of the coil conductor 32 can be increased by increasing the external size of the coil conductor 32, and as a result, the improvement of the inductance of the electronic component 1 can be achieved.

Figure 20:
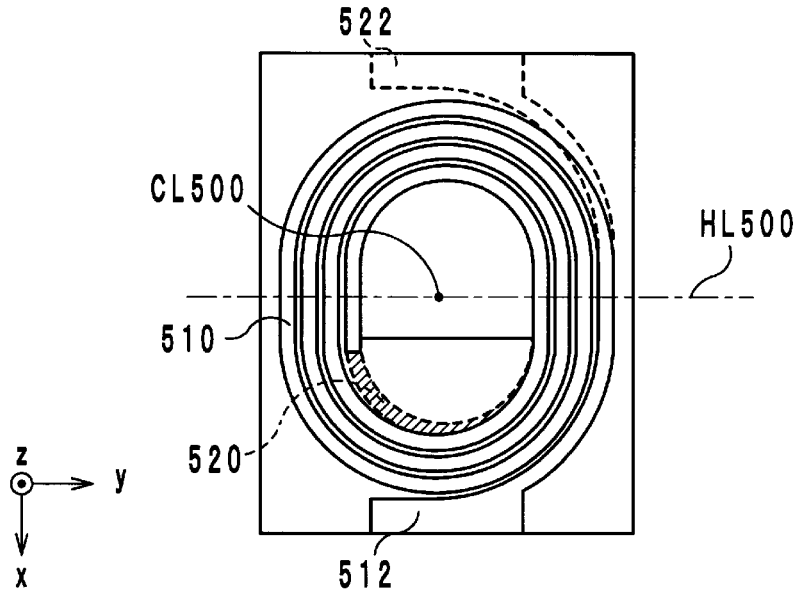
FIG. 20 PRIOR ART
FIG. 20 is a plan view illustrating the coil conductor and the connecting electrode of the electronic component, which is the same type as the inductor described in Japanese Unexamined Patent Application No. 2014-22723, as seen from the direction perpendicular to the bottom surface.

In the electronic component 500 of the related art, as indicated by a hatched portion illustrated in FIG. 20, the coil conductor 520 projects into a region on the inner periphery side of the coil conductor 510 when seen in plan view from the z-axis direction, and as a result, an internal magnetic path is narrowed. On the other hand, in the electronic component 1, a space within the electronic component 1, which corresponds to a space within the electronic component 500 of the related art that has not been used, is used as a space in which the coil conductor 32 is disposed, so that the coil conductor 32 can be positioned such that an area of the coil conductor 37, which corresponds to the coil conductor 520, that projects toward the inner periphery side of the coil conductor 32 when seen in plan view from the z-axis direction is reduced. Consequently, an internal magnetic path of the coil 30 of the electronic component 1 is larger than the internal magnetic path of the coil 501 of the electronic component 500 of the related art, and accordingly, the inductance of the electronic component 1 is improved.

In order to confirm the above advantageous effects, the inventors of the present application measured the inductance of a first sample that corresponds to the electronic component 1 and the inductance of a second sample that corresponds to the electronic component 500 of the related art. The size of the first sample and the size of the second sample are the same as each other, and each of the first and second samples has a long edge of 1.6 mm, a short edge of 1.2 mm, and a height of 0.3 mm. In addition, the number of turns of a coil that is included in the first sample and the number of turns of a coil that is included in the second sample are the same as each other, and the line width, the conductor spacing, and the thickness of a coil conductor that is included in the coil, which is included in the first sample, and the line width, the conductor spacing, and the thickness of a coil conductor that is included in the coil, which is included in the second sample, are the same as one another. More specifically, the number of turns of each of the coils is 9.5, and each of the coil conductors included in the coils has a line width of 65 μm, a conductor spacing of 10 μm, and a thickness of 45 μm. However, the external size of the coil conductor of the first sample in the x-axis direction is larger than the external size of the coil conductor of the second sample by 60 μm. The inductance measurement results were as follows: the inductance of the first sample was 0.422 μH, and the inductance of the second sample was 0.400 μH. Accordingly, the inductance of the first sample, which corresponds to the electronic component 1, is larger than the inductance of the second sample, which corresponds to the electronic component 500 of the related art. In other words, the results show that the inductance of the electronic component 1 is improved more than the inductance of an electronic component of the related art.

Along with a reduction in the size of an electronic component, the occupancy of a substantially columnar electrode inside the electronic component becomes large. This is because it is necessary to maintain the size of the substantially columnar electrode to be equal to or larger than a certain size when the electric resistance of a portion that connects an outer electrode and a coil conductor is set to be smaller than a predetermined value. Therefore, advantageous effects obtained by, like the electronic component 1, using a space within the electronic component 1, which corresponds to a space within the electronic component 500 of the related art that has not been used, as a space in which the coil conductor 32 is disposed will become notable as the size of the electronic component is decreased.

Other Embodiments

The electronic component according to the present disclosure is not limited to the above-described embodiment, and various modifications can be made within the scope of the present disclosure. For example, the number of turns of coils and the shapes and the positions of columnar electrodes and bottom-surface electrodes are arbitrary.

As described above, the present disclosure is useful in an electronic component that is equipped with a coil and has an advantage of improving the inductance of such an electronic component.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. An electronic component comprising: a main body that is formed of an insulator; a coil that includes a first coil conductor that is disposed on a first plane, which is positioned within the main body, and a second coil conductor that is disposed on a second plane, which is parallel to the first plane within the main body, so as to be superposed with the first coil conductor when viewed from a perpendicular direction, which is perpendicular to the first plane; a first outer electrode that includes a first bottom-surface electrode located on a bottom surface of the main body, which is parallel to the first plane, and a first substantially columnar electrode extending from the first bottom-surface electrode toward a first end portion of the first coil conductor and that is electrically connected to the first coil conductor; and a second outer electrode that includes a second bottom-surface electrode located on the bottom surface of the main body and a second substantially columnar electrode extending from the second bottom-surface electrode toward a second end portion of the second coil conductor and that is electrically connected to the second coil conductor, wherein the second coil conductor is positioned between the first coil conductor and the bottom surface of the main body, wherein the first substantially columnar electrode is positioned so as to oppose the second substantially columnar electrode across a central axis of the coil when viewed from the perpendicular direction, wherein a portion of an outermost periphery of the first coil conductor is superposed with the second substantially columnar electrode when viewed from the perpendicular direction, and wherein a smallest distance between the first coil conductor and a first side surface of the main body is smaller than a smallest distance between the second coil conductor and a second side surface of the main body.

2. The electronic component according to claim 1, wherein the smallest distance between the first coil conductor and the first side surface of the main body is half or less of the smallest distance between the second coil conductor and the second side surface of the main body.

3. The electronic component according to claim 1, wherein the shape of the first coil conductor and the shape of the second coil conductor are each a substantially spiral shape that includes a plurality of substantially linear portions and a plurality of substantially arc portions, which are connected to both end portions of the substantially linear portions, and wherein, when viewed from the perpendicular direction, each of central axes of portions of the first coil conductor, which are parts of the substantially linear portions of the first coil conductor, coincides with a corresponding one of central axes of portions of the second coil conductor, which are parts of the substantially linear portions of the second coil conductor, the portions of the first coil conductor being superposed with the corresponding portions of the second coil conductor when viewed from the perpendicular direction, the central axes of the portions of the first coil conductor passing through midpoints of the corresponding portions of the first coil conductor in a width direction of the portions of the first coil conductor, the central axes of the portions of the second coil conductor passing through midpoints of the corresponding portions of the second coil conductor in a width direction of the portions of the second coil conductor, and each of the central axes being parallel to an extending direction, which is perpendicular to the width direction.

* * * * *